United States Patent [19]

Estabrook

[11] 4,253,198

[45] Mar. 3, 1981

[54] RESCUE SUIT

[76] Inventor: James R. Estabrook, 17 Waterhouse St., Somerville, Mass. 02143

[21] Appl. No.: 43,385

[22] Filed: May 29, 1979

[51] Int. Cl.[3] ..... A41D 3/00; A41D 13/00

[52] U.S. Cl. ..... 2/82; 2/79; 2/84; 2/2

[58] Field of Search ..... 2/82, 79, 84, DIG. 11, 2/80, 2, 2.1 R, 2.1 A; 36/87, 4

[56] References Cited

U.S. PATENT DOCUMENTS

| | | | |
|---|---|---|---|
| 1,322,602 | 11/1919 | Nogar | 2/82 |
| 2,348,793 | 5/1944 | Dybberg | 2/82 |
| 2,568,304 | 9/1951 | Shoenbrun | 2/80 X |

FOREIGN PATENT DOCUMENTS

| | | | |
|---|---|---|---|
| 1074476 | 3/1954 | France | 2/DIG. 1 |

*Primary Examiner*—H. Hampton Hunter

[57] ABSTRACT

A rescue suit having belt loops positioned on the external surface of the suit, in close proximity to the line of the armpits, which engage a belt that holds a D ring for engaging a life line at the body of the suit. The rescue suit also has integral boots completely or partially coated with a tough, tear and puncture resistant plastic, a strip of highly reflective tape attached horizontally on the back of the suit near the shoulder line and a cinch strap located to circumscribe each leg near the upper thigh close to the crotch area.

Reflective strips of tape may also be attached and circumscribe the suit at the wrists. A mask may be engaged to the inner surface of the hood. The mask is adapted to fully cover the face except for an eye-nose opening and may have sufficient length to extend under the zipper.

7 Claims, 3 Drawing Figures

RESCUE SUIT

BACKGROUND OF THE INVENTION

Accidental or intentional immersion of an individual in cold ocean or lake water, at a distance from an area of safety and in water below 33° C. may result in drowning or hypothermia. In cases where the immersed individual was wearing a flotation device, the danger of drowning is substantially reduced. However, unless insulated clothing is worn hypothermia will occur fairly rapidly, although the time of onset of "critical" hypothermia will vary with the physical characteristics of the immersed individual, the type of clothing he is wearing and the water temperature. One fact is certain; the faster an immersed person is removed from the cold water, the better.

The rescue suit disclosed in this specification is designed to reduce the period of time necessary for moving an individual immersed in cold water to a safe area while maintaining the rescuer in as safe a condition as is possible. For example, where the immersion occurs fairly close to a shoreline, the rescuer dons the suit on shore, runs to the water, swims to the immersed person, takes hold of him and returns with him to shore. Many beaches, from which such a rescue is initiated, have obstacles such as rocks or tree limbs capable of puncturing or tearing the materials, neoprene, for example, which have sufficient flotation and insulation characteristics for use in a rescue suit. The inventor by providing a tough coating on the boot or by forming the boot of a tough material protects the area where tears or punctures are most likely to occur. Obviously, a tear or puncture which penetrates through the boot will permit the cold water to enter the suit causing discomfort and, in some cases, loss of physical and mental efficiency of the wearer. Piers and the decks of vessels, from which a rescue may be initiated, are also frequently cluttered with items that are capable of tearing or puncturing a rescue suit so that the tough boot would be effective in those areas.

Once the immersed individual has been contacted by the rescuer, he must be removed from the water as quickly as possible. Swimming the immersed individual to a place of safety is time consuming and may, under certain conditions, be difficult to accomplish. The inventor, by providing belt loops engaged to a belt that is positioned in close proximity to the armpits of the suit and engaged to a D ring located at the back of the suit, furnishes a means of quickly and easily engaging a lifeline which can be utilized to rapidly pull the rescuer and the person he has rescued to a place of safety. Positioning the belt under or in proximity to the armpits allows the rescuer to be pulled without tipping him forward. A forward tip would result in immersing his face in the water with obvious detrimental results.

Mobility while wearing the cumbersome rescue suit is very important. The need to run, walk or kick the legs while swimming is self-evident. Mobility of the inventor's rescue suit is provided by cinch straps, one of which is adapted to engaged around each leg close to the crotch area. After donning the suit, the wearer can pull up on each suit leg and cinch it in place, thereby assuring the greatest possible leg mobility.

Rescues are frequently conducted under heavy spray, mist or other poor visibility conditions. It is desirable that the rescuer's helpers, positioned at a safe area, be able to locate him. The inventor's rescue suit includes reflective strips of tape which are located aross the upper back of the suit and around each wrist. The rescuer by raising and waving an arm will, through the reflectivity of the wrist tape, be able to signal his helpers even under poor visibility conditions.

Where the rescue occurs in heavy seas or in adverse weather conditions such as rain, sleet or snow, the face of the rescuer should be as completely covered as possible. The inventor's rescue suit may include a mask which is sufficiently wide to lie under the edges of the face opening and has sufficient length to lie under the upper portion of the zipper when the zipper is engaged. An opening is provided in the mask for exposure of only the eyes and nose of the wearer. This design provides maximum, efficient facial protection for the wearer and also assists in preventing water from entering the suit in the face and neck area.

SUMMARY OF THE INVENTION

The rescue suit according to the present invention is characterized by including a belt engaged around the suit at the chest area. The belt is passed through a D ring locating the ring at the back of the suit. The ring is engageable with a lifeline. The suit may have a cinch belt attached to each leg. The cinch belt is adapted to be fastened around the leg in the thigh area. The suit may have integral boots which are completely or partially coated with a tough tear and puncture resistant material. The boot may be completely formed of the tear and puncture resistant material.

The rescue suit may include a mask which has edges fitting under the edges of the facial opening, which has an eye and nose opening of smaller area than the facial opening and which has sufficient length to fit under the upper portion of the zipper when it is closed.

The residue suit may also include reflective and/or brightly colored strips of tape positioned horizontally on the back of the suit at the shoulder line and around each wrist of the suit.

The rescue suit may include one or any combination of two or more of the design features set out in this summary.

BRIEF DESCRIPTION OF THE DRAWING

Further details are explained hereinafter with the help of the views in the attached drawing in which.

DESCRIPTION OF THE PREFERRED EMBODIMENTS

Figure 1:
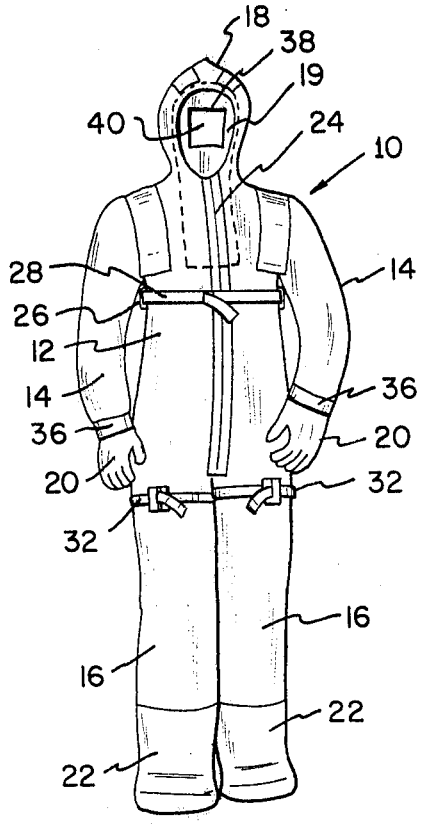
FIG. 1 is a front elevational view of the rescue suit according to the present invention.
Figure 2:
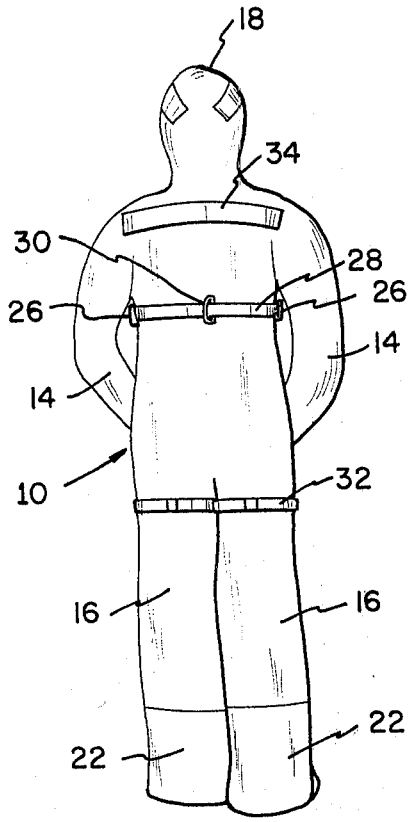
FIG. 2 is a rear elevational view of the rescue suit shown in FIG. 1.
Figure 3:
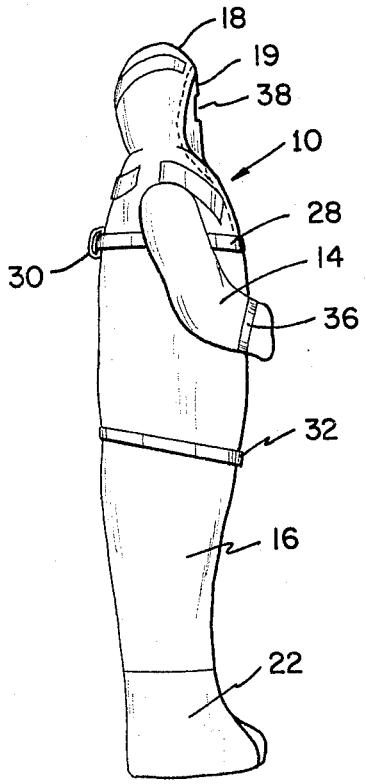
FIG. 3 is a side elevational view of the rescue unit shown in FIG. 1.

There is shown in the drawing a rescue suit 10 including body portion 12, a pair of arm portions 14, a pair of leg portions 16 and a hood portion 18. The suit 10 has the general external configuration of the human body with the arm, leg, and body portions positioned to conform to the position of the head and limbs of the human body. The hood portion 18 is positioned on the suit to fit over the user's head when the suit 10 is worn and has a facial opening 19. The free end of each arm portion 14 terminates in an integral glove 20 and the free end of each leg portion 16 terminates in an integral boot 22. The arm, leg, body and hood portions are integral to provide a basic suit of one piece construction. The suit 10 disclosed in the drawing is of the dry suit type which is a construction that prevents entry of water when the user is immersed in water. In the construction disclosed when properly donned only the face of the wearer, from chin to hair line, is exposed unless a mask is worn.

A vertical separation is formed on the front midline of the body portion 12 extending from the neck area to the crotch area. The edges of the separation have a waterproof zipper 24 engaged thereto which opens from the neck to the crotch and which permits the user to don the suit and then zip it closed in a substantially watertight fashion. The suit 10 may be formed of a closed-cell foam material such as "Neoprene" or "Ensolite" which will provide flotation. Each of the boots 22 has its complete external surface coated with a tough, wear-resistant plastic, or may, if desired, only have a portion coated, for example, the sole. A wide belt loop 26 is attached, on a line circumscribing the body portion 12 slightly below the armpits, on the external surface of the body portion 12 at each side thereof. A belt 28 having a D ring 30 transversely engaged thereto may be passed through the loops 26 and adjusted to locate the D ring 30 on the plane at which the loops 26 are engaged in the middle of the back of the external surface of the body portion 12 for a purpose to be set forth hereinafter.

A cinch strap 32 attached to the rear exterior surface of each leg portion 16 in close proximity to the hip-crotch area line, is adapted to circumscribe the leg portion 16 and has a buckle at one terminal end engageable with the other end. Obviously other engagement means such as D rings may be used. The hood portion 18 may include fastening means for engaging a substantially waterproof neck shield (not shown) to assist in preventing water from entering the suit at the jaws or neck. A rescue suit is typically both bulky and loosely fitted to the body. This sizing permits a suit to be worn by individuals ranging in size from 5' to 6'4" in height. Comfort and mobility of the wearer during use are very important functional characteristics along with the prime consideration of resistance to cold (i.e. thermal protection). The glove 20 may be of mitten or of three or five finger construction.

Highly reflective and visible strips 34 of tape are positioned from each shoulder vertically down over the adjacent breast portion, on each side of the hood 18 substantially vertically from the top of the hood over the back of the hood, horizontally across the back of the suit in close proximity to the neck and shoulders and similar strips 36 are positioned circumferentially on each wrist area.

A mask 38 may be attached at one of its ends to the undersurface of the hood 18 in close proximity to the upper edge of the facial opening 19. The mask 38 is manufactured with sufficient width to extend beyond the side edges defining the facial opening 19, has a centrally located opening 40 for the nose and eyes of the wearer and has sufficient length to extend below the neck and shoulder line at the front of the suit. The mask 38 may be provided with sufficient length to lie behind a portion of the closed zipper 24. When the mask 38 is not in use it may be stored to lie along the inner top and back surface of the hood 18 and if necessary along the inner surface of the back of the suit. If desired, fasteners such as a snap fastener may be attached to the inner surface of the suit and to the free end of the mask 38 to assist in storage of the mask 38.

To don the suit 10, the wearer steps into the suit, then lifts the upper suit portion, inserts his arms and pulls the hood 18 forward over his head. The zipper 24 is pulled up and locked under the chin. One of the cinch straps 32 is tightly engaged around each of the leg portions 16, with the foot of the wearer bearing against the insole of the boot 22 and the leg portion 16 pulled up. Cinching of the leg portion 16 substantially increases the mobility of the wearer since it prevents the leg portions from excess movement when the wearer runs or otherwise uses his legs. The belt 26 is tightened about the body portion 12 after the D ring 30 has been positioned in the center of the back of the suit 10. The D ring 30 is attached to a lifeline held by assistants located on shore or on the deck of a vessel. Time is very important when rescuing a person immersed in cold water. The lifeline permits the wearer of the suit, after he has contacted the person to be rescued and has grasped him to be quickly pulled to a place of safety. Obviously, the lifeline also provides additional security to the wearer of the suit 10.

The rescue suit 10 may be used in sea and deep water rescues from land and docks as well as from vessels. Land, dock and deck areas may contain many obstructions such as rocks, machinery, dead branches, etc., all of which are capable of puncturing or cutting through the boot of the suit. Such an opening would allow penetration of the frigid water within the suit during immersion. The inventor, by coating the boot with a tough material or by forming the boot of a much tougher material than the remainder of the suit 10, substantially reduces the possibility of such accidental puncture. The tougher material is extended above the ankle area of the wearer and may, if desired, be brought up to a circumferential line slightly below the knee. The tough coating may, if desired, only be placed on the sole of each boot 22.

What I claim is:

1. A rescue suit to be worn by a human in cold water, the suit comprising a body portion, a pair of arm portions and a pair of leg portions extending from the body portion, each of the leg portions terminating in a boot portion and each of the arms terminating in a glove portion, each of the boot portions including material having greater tensile strength than the remaining part of the leg portion, the body portion having an external surface, a first belt loop and a second belt loop extending from the external surface, the first belt loop positioned in close proximity to the junction between an arm portion and the body portion and the second belt loop positioned in close proximity to the junction between the other arm portion and the body portion, and a safety belt positioned within said belt loops for securement of a rescue device.

2. A rescue suit to be worn by a human in cold water, the suit comprising a body portion, a pair of arm portions and a pair of leg portions extending from the body portion, the body portion, arm portions and leg portions having, in combination, the general external configuration of a human body, each of the leg portions having a leg external surface and having a cinch strap engaged to the leg external surface in close proximity to the body portion, the body portion having an external surface, a first belt loop and a second belt loop extending from the external surface, the first belt loop positioned in close proximity to the junction between an arm portion and the body portion and the second belt loop positioned in close proximity to the junction between the other arm portion and the body portion, and a safety belt positioned within said belt loops for securement of a rescue device.

3. A rescue suit to be worn by a human in cold water, the suit comprising a body portion, a pair of arm portions and a pair of leg portions extending from the body portion, the body portion, arm portions and leg portions defining, in combination, the general external configuration of the human body, the body portion having a front external surface and a rear external surface and having a safety belt in removeable, circumscribing relation thereto, the safety belt having a D ring engaged thereto in close proximity to the rear external surface.

4. A rescue suit as set forth in claim 2 further comprising a strip of highly visible tape, at least one of the arm portions having a wrist, the strip of tape positioned in circumscribing relation to the wrist.

5. A rescue suit as set forth in claim 2 further comprising a mask and a hood portion, the hood portion extending from the body portion and including an edge defining a facial opening, and an inner surface, the mask extending from the hood portion and having an opening whereby the mask may be positioned across the facial opening.

6. A rescue suit as set forth in claim 1 wherein each of the leg portions having a leg external surface and having a cinch strap engaged to the leg external surface in close proximity to the body portion.

7. A rescue suit as set forth in claim 6 wherein the external surface comprises a front external surface and a rear external surface, and said safety belt in removeable, circumscribing relation to the body portion, the safety belt having a D ring engaged thereto, in close proximity to the rear external surface.

* * * * *